US006604851B1

(12) United States Patent
Lizzi et al.

(10) Patent No.: US 6,604,851 B1
(45) Date of Patent: Aug. 12, 2003

(54) METHOD FOR SETTING A MULTIMODE ELECTRONIC DEVICE

(75) Inventors: Ronald S. Lizzi, West Hartford, CT (US); Nino L. Sarmiento, Waterbury, CT (US); Edward J. Daly, Bristol, CT (US); Richard D. Ciervo, New Britain, CT (US); Robert Demarchi, Wallingford, CT (US); Manjunath Garalapuraiaha, Farmington, CT (US); John T. Houlihan, Watertown, CT (US); John L. Garay, Southbury, CT (US); Skip Kurdi, Spring, TX (US)

(73) Assignee: Timex Group B.V. (NL)

( * ) Notice: Subject to any disclaimer, the term of this patent is extended or adjusted under 35 U.S.C. 154(b) by 89 days.

(21) Appl. No.: 09/692,565

(22) Filed: Oct. 19, 2000

(51) Int. Cl.[7] ..... G04C 9/00; G04C 17/00; G04B 19/00

(52) U.S. Cl. ..... 368/187

(58) Field of Search ..... 368/69, 70, 73, 368/187, 188, 190

(56) References Cited

U.S. PATENT DOCUMENTS

| | | | | | |
|---|---|---|---|---|---|
| 4,209,976 | A | | 7/1980 | Flumm | |
| 4,283,784 | A | | 8/1981 | Horan | |
| 4,419,018 | A | | 12/1983 | Meyrat | |
| 4,780,864 | A | | 10/1988 | Houlihan | |
| 4,783,773 | A | | 11/1988 | Houlihan et al. | |
| 4,989,188 | A | * | 1/1991 | Thinesen | 368/70 |
| 5,140,563 | A | * | 8/1992 | Thinesen | 368/70 |
| 5,226,022 | A | * | 7/1993 | Thinesen | 368/70 |
| 5,257,245 | A | * | 10/1993 | Thinesen | 368/70 |
| 5,555,226 | A | | 9/1996 | Lizzi | |
| 5,587,971 | A | * | 12/1996 | Thinesen | 368/70 |
| 5,625,336 | A | * | 4/1997 | Yamamoto | 368/70 |
| 5,742,565 | A | | 4/1998 | Cuinet et al. | |

OTHER PUBLICATIONS

Copy of instruction booklet for Tissot Digital Analog Watches—pp. 1–16.*

* cited by examiner

*Primary Examiner*—Vit Miska
*Assistant Examiner*—Jeanne-Marguerite Goodwin
(74) *Attorney, Agent, or Firm*—Carmody & Torrance LLP

(57) ABSTRACT

A method of setting a multimode electronic device operable in a current mode, a mode setting mode and a next mode. If a predetermined number of electrical signals are generated prior to the expiration of a predetermined period of time, the electronic device exits the current mode and enters the next mode. Locking conditions are also provided to assist in ensuring the device remains in a "home," such as the time-of-day, mode. In one embodiment, the switching mechanism includes a rotating setting stem and the electronic device is a watch.

16 Claims, 1 Drawing Sheet

METHOD FOR SETTING A MULTIMODE ELECTRONIC DEVICE

BACKGROUND OF THE INVENTION

The present invention relates generally to setting methodologies for electronic devices, such as, but not limited to wrist-worn watches, and in particular, to an improved setting methodology for an electronic device that includes a rotatable setting stem and a crown coupled thereto, wherein the method provides for the prevention of unintended and/or undesirable mode, information and/or display changes, notwithstanding that the crown and/or setting stem may inadvertently or undesirably rotate.

Many conventional watches are known in which a setting stem and a crown coupled thereto can be rotated to adjust or select information on the display on the watch. In a conventional analog watch for example, the rotation of the crown, when the setting stem is in a "neutral" position, may not necessarily cause a change in the displayed time. This is most likely due to the conventional design thereof in which the crown must first be pulled from its "neutral" position to a second position before the watch hands would be movable due to a rotation of the crown. In one improved construction, of which the present assignee is the owner, the top ring of the watch can be used to rotate the crown. This construction, disclosed and claimed in U.S. Pat. No. 5,742,565, describes how the setting stem, while in the "neutral" position, need not change the hands that tell time notwithstanding the fact that it is rotating.

In recent years, a rotating setting stem and/or crown construction has been used as a means to adjust the time or other information and/or change modes or the like in digital watches, thus eliminating the use of multi-function pushers, and hence making such watches more "user friendly". Two such examples of such a crown setting mechanism for use in a digital watch are described in U.S. Pat. Nos. 4,209,976 and 4,419,018.

As would be expected, watch designers are continuously constructing electronic devices, such as watches, to be more and more "user friendly". One such attempt at simplifying the setting of such a timepiece is to eliminate the need to first "pull" the setting stem before any mode setting can occur. However, the decision to have the watch able to change information or modes (for example) while the setting stem is in what is considered the "neutral" position gives rise to certain problems, one of which is that accidental or inadvertent rotation of the setting stem while it is in the "neutral" position may frustrate or annoy the user since the mode or information being displayed could be subject to undesirable change.

Another perceived deficiency in the prior art is that a user must be precise when setting such watches. For example, after setting the alarm or date, the user would typically want to put the watch back in the "TIME" mode where the time is displayed. Often, this requires the user to cycle through the plurality of modes until the TIME mode appears. Such a procedure often takes concentration so as not to pass the TIME mode inadvertently, since passing it would require the user to recycle through the modes a second time. To require precise setting is undesirable since such need be precise is difficult for those with less than perfect hand/eye coordination or finger dexterity or for those where speed is of the essence such as in high performance athletics.

As it is now known to cause the rotation of the setting stem by rotation of the crown or a top ring, it is desirable to provide a electronic device construction that is both "user friendly" as described above, while at the same time incorporates setting methodologies that eliminate the frustrating and annoying potential results due to undesirable or inadvertent crown, top ring and thus setting stem rotation. It is also desirable to provide an electronic device that allows a user to more easily set it (such as by more easily and quickly allowing a user to have the device return to the "HOME" or "TIME" mode). The present invention achieves the aforementioned and below mentioned advantages.

OBJECTS AND SUMMARY OF THE INVENTION

Accordingly, it is an object of the present invention to provide an improved setting methodology for multimode electronic devices and, in particular, for digital and combination analog and digital timepieces, such as wristwatches, that overcomes the foregoing and other problems.

It is another object and advantage of this invention to provide an improved setting methodology for such electronic devices that eliminates the effects of unintended or undesirable crown or top ring movement if such movement is operatively coupled to the rotation of the setting stem.

It is yet another object and advantage of this invention to provide an improved setting methodology that permits a still further simplified mechanical construction so as to provide a more "user friendly" digital and/or combination analog and digital timepiece, such as a watch.

Further objects and advantages of this invention will become more apparent from a consideration of the drawings and ensuing description.

The foregoing and other problems are overcome and the objects and advantages are realized by methods in accordance with embodiments of this invention, wherein improved setting methodologies for a multimode electronic device are disclosed.

Generally speaking, a method of setting a multimode electronic device, of the type having a switching mechanism that generates intermittent electrical signals when the switching mechanism is displaced in either a first or second direction and an integrated circuit operable in at least a current mode, a mode setting mode and a next mode and operatively coupled to the switching mechanism, is disclosed. In accordance with a first embodiment, the method comprises the steps of detecting a first electrical signal generated by the switching mechanism, determining whether a predetermined number of electrical signals are generated prior to the expiration of a predetermined period of time, and if so, causing the electronic device to exit the current mode and enter the next mode.

In another embodiment of the invention, the method comprises the steps of, while the electronic device is in the current mode, detecting an electrical signal generated by the switching mechanism, causing the electronic device to exit the current mode and enter a next mode, determining whether the next mode is the "home" mode and if so, not permitting the electronic device to exit the "home" mode and enter a next mode for a predetermined period of time. This embodiment allows a user for example, to set another function (such as the alarm or date), and cause the device to more quickly and easily allow the user to return to the HOME mode, such as the TIME mode, where the time is displayed. Such an embodiment is advantageous in the situation where the user has less than perfect hand/eye coordination or finger dexterity or where speed in setting the device is of essence.

In yet a third aspect of the invention, the method comprises the steps of determining whether a crown lock condition is locked, and if so, preventing the electronic device from exiting the current mode and entering the next mode until a predetermined number of electrical signals are generated prior to the expiration of a predetermined period of time. The method may also include the steps of unlocking the crown lock condition, starting a Lock Timer, determining whether an electrical signal is detected prior to the expiration of the Lock Timer, and if not, locking the crown lock condition. Still further, after the step of locking the crown lock condition, the method may include the steps of detecting a first electrical signal generated by the switching mechanism, determining whether a predetermined number of electrical signals are generated prior to the expiration of a predetermined period of time, and if so, causing the electronic device to exit the current mode and enter the next mode.

In the preferred embodiment, the switching mechanism includes a rotating setting stem and the electronic device is a watch.

DETAILED DESCRIPTION OF THE PREFERRED EMBODIMENT

Figure 1:
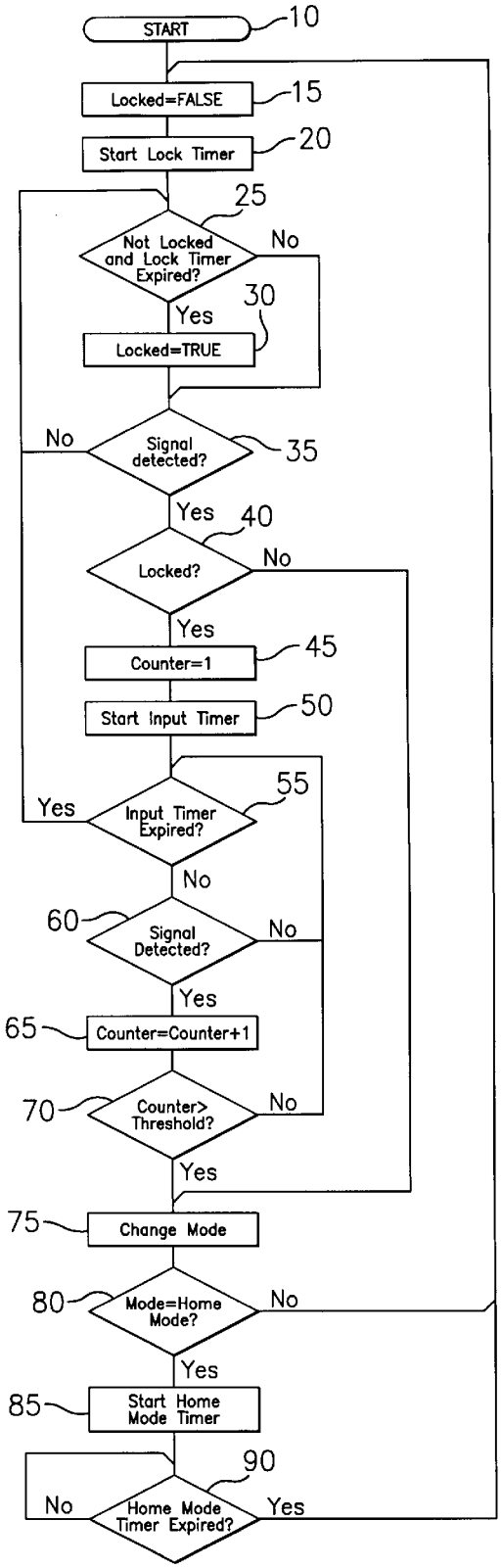
FIG. 1 illustrates a flow diagram of a setting methodology for varying aspects for setting modes and functions for an electronic device constructed in accordance with the present invention.

Generally speaking, the present invention is directed to an improved methodology for setting electronic devices, such as timepieces, including, but not limited to, wristworn watches. Accordingly, the particular mechanical construction is not material to the present invention. However, for completeness, it should be understood that the present invention is compatible with the mechanical embodiments disclosed in commonly assigned, copending U.S. Pat. No. 6,146,101, filed on Mar. 8, 1999, entitled "Combined Crown and Pusher Electro Mechanism," by Michel G. Plancon, U.S. Pat. No. 6,203,190, filed on Jun. 7, 1999, entitled "Crown Switching Mechanism," by Gerhard Stotz, and Application Ser. No. 09/359,223, filed on Jul. 22, 1999, entitled "Setting Functions For A Multimode Timepiece" by G. Stotz, et al., the disclosures of which are incorporated by reference as if fully set forth herein.

As set forth in one embodiment and disclosed in greater detail in Application Ser. No. 09/359,223, the switching mechanism may be represented by a crown switching mechanism having a setting stem and a switching device. The setting stem is preferably mounted through a bore of a watchcase and cooperates with a spring plate and a detent spring such that the setting stem may be disposed in a plurality of axial setting positions. The axial setting positions may include, but are not limited to, for example, a normal "run" position, a "first pulled" or "time setting" position and a "second pulled" or "alternate setting" position. The setting stem may include integrally formed teeth that cooperate with the switching device to generate intermittent first and second electrical signals. The intermittent first and second electrical signals indicate a rotation of the setting stem, for example, the setting stem may be manipulated in a clockwise or a counterclockwise rotational direction. The switching device preferably includes a spring switch arm, a first electrical contact and a second electrical contact. The spring switch arm is preferably aligned with an axis of rotation of the setting stem and has an end thereof positioned between the first electrical contact and the second electrical contact. In accordance with the mechanical construction, as the setting stem is rotated the teeth of the setting stem deflect the spring switch arm to engage the first electrical contact or the second electrical contact. As a result of this engagement, an electrical connection is formed between the spring switch arm and either the first electrical contact or the second electrical contact. The electrical connections generate respective intermittent first and second electrical pulses that represent a set of input signals to the microcomputer. The above referenced copending U.S. Pat. No. 6,203,190, also describes in detail the above embodiment of the switching mechanism.

As also explained in the aforementioned applications, the switching mechanism may be in mechanical engagement with a rotatable ring, for example, a rotatable top ring such as that described in the aforementioned U.S. Pat. No. 5,742,565. The foregoing disclosure adequately sets forth the preferred mechanical implementation for use in connection with the present invention.

While the aforementioned applications disclose the mechanical embodiments, the timekeeping functions of such a timepiece are well known in the art, and described in such patents as commonly assigned, U.S. Pat. Nos. 4,783,773, issued Nov. 8, 1988 to Houlihan et al.; U.S. Pat. No. 4,780,864, issued Oct. 25, 1988 to Houlihan; U.S. Pat. No. 5,555,226, issued Sep. 10, 1996, to Ronald S. Lizzi and U.S. Pat. No. 4,283,784 issued Aug. 11, 1981 to Horan, the disclosures of which are incorporated by reference as if fully set forth herein.

As should now be clear, rotation of the crown and/or top ring resulting in the rotation of the setting stem as disclosed above simplifies the procedure and steps in programming and/or setting the timekeeping functions in such watches, and specifically, may readily be used in place of the manual activated side and top pushers described in the aforementioned commonly owned patents. For example, the pushers, once used for selectively cycling the timepiece through multiple operating modes and setting function states such as, for example, a time-of-day (TOD) mode, a chronograph (CHRONO) mode, an alarm setting (ALARM) mode, an elapsed timer (TIMER) mode, and even an alternate time zone (T2) mode, can now be more easily achieved by the rotation of the setting stem by way of the rotating top ring and/or crown.

As set forth above and in the aforementioned applications, mode setting may be achieved, inter alia, when the setting stem is in a multitude of "pulled" positions. However, to still further simplify the setting procedures, the mode (or other information) setting may be achieved while the setting stem is in the first or "neutral" position, that is, while the setting stem is in the normal "run" position. However, with this construction, a perceived problem may occur, namely inadvertent or undesirable contact with the crown or top ring may cause undesirable mode changes, such as from the TOD mode to the CHRONO mode, the ALARM mode, the TIMER mode or whatever other modes may follow. Accordingly there is a perceived need to ensure that rotation of the top ring or crown, and thus the setting stem, is deliberate and desirable. Alternatively articulated, there is a perceived need to ensure that inadvertent or undesirable rotation of the top ring or crown does not cause any mode or information changes.

Therefore, reference is now made to FIG. 1, for a detailed description of the setting methodology in accordance with the present invention. Generally speaking, and as further set forth below, there are three (3) main aspects to the present invention. First, the present invention achieves the ability to change modes only upon the initial detection of a predetermined number of electrical signals prior to the expiration of a predetermined period of time. This first aspect of the present invention overcomes the aforementioned perceived deficiency wherein inadvertent or undesirable contact with the crown or top ring could cause a rotation of the setting stem and could change the mode (or display) of the electronic device.

Secondly, the present invention recognizes that a user would most likely want to more easily maintain the display of the device in a particular "home" mode. That is, even after setting/changing an alarm, timer or other mode of the device, the user would desire to more easily return to the most often viewed mode, such as the TOD mode. Thus, it is an aspect of the present invention to permit rotation of the crown or top ring (thus causing rotation of the setting stem) to effectuate mode changes, but upon the cycling through of the modes and return to the "home" mode, the device will remain in the "home" mode for an extended period of time, such as six (6) seconds. This aspect of the invention further recognizes that users of the electronic device could inadvertently, undesirably, or (in the case of users with less than perfect hand/eye coordination or finger dexterity) uncontrollably or inadvertently continually pass the "home" mode (i.e. TOD mode, for example). This aspect also recognizes that users, once they realize that this advantageous feature is present, may deliberately and/or quickly just "spin" the top ring or crown, knowing that the cycling of modes will stop when the "HOME" mode is reached. This is especially advantageous where speed setting is critical such as in high performance athletics. For these reasons, it is a perceived desirability to ignore any overrotation of the top ring or crown that may have otherwise caused the "passing" of the time-of-day mode. The present invention thus provides for the determining of whether the "next" mode in which the device is entering is a preselected mode (i.e. the "home" mode) and if so, not permitting the electronic device to exit the preselected mode and enter a further next mode until the expiration of a predetermined period of time.

Thirdly, and complementary with the first aspect, is the introduction of a software implemented crown locking feature, whereby after a period of non-use of the electronic device, a "flag" or condition is set or "locked" (in the present application this condition is coined "the crown lock condition") so that the device can differentiate between periods of continued use and non-use of the device, and thus require a certain amount of setting stem rotation to again "unlock" the crown lock.

Reference is now made to the specifics of FIG. 1 for a more detailed description of the preferred embodiment of the present invention. While it can be readily seen that the software routine may be thought of as "starting" at the "Start Block" 10, for ease of illustration and description reference will first be made to Block 35. It should be understood that no limitation arises from a description as such. That is, it will be assumed, for illustrative purposes only, that the setting stem, through the manipulation of a crown, top ring or the like, has not been rotated for an extended period of time, such as for example, more than several minutes, although in practice, as will be understood below, inaction by a user for more than six seconds could even place the software routine at Block 35.

Therefore, the subroutine in accordance with the invention may be seen to be looping among the several Blocks 25–35, in effect continually checking for the detection of a signal. In the present invention, the "signal" that is being detected is an electrical signal, preferably the type described in the aforementioned applications, and namely, the detection of a signal indicating that the setting stem is rotating either clockwise or counterclockwise. As soon as the first electrical signal is detected at Block 35, control passes to Block 40 where it is determined whether a condition is satisfied. As stated above, this "crown lock condition," is deemed satisfied if the condition is "locked". However, this terminology is merely one of convenience, as one skilled in the art would readily appreciate that the present invention could be described with inverted logic while still remaining within the scope of the invention.

The crown lock condition is deemed "locked," after a preset period of non-use of the electronic device. While this "non-use" can obviously be several minutes to several days, the period of "non-use" may be as short as several seconds. That is, if the watch has not been in use for an extended period of time, it is desirable not to have the electronic device exit the mode the device is currently in (i.e. the "current mode") until it can be determined that the rotation of the setting stem is deliberate. For this reason, upon the detection of the first electrical signal, control passes to Block 45 wherein a Counter is initialized. Thereafter, control passes to Block 50 where an Input Timer is initialized. This Input Timer ensures that a predetermined amount of rotation of the setting stem occurs (i.e. a sufficient number of electrical signals are detected) within a prescribed period to ensure that such rotation is deliberate and desirable. For this reason it is determined whether, prior to the expiration of the Input Timer at Block 55, at least a second electrical signal is detected at Block 60. If no signal is detected, control passes back to Block 55 wherein the subroutine continually looks for an additional electrical signal during the period prior to the expiration of the Input Timer. In this way, it can clearly be seen that one insignificant incremental turn of the crown or the top ring (i.e. and thus the setting stem) will not cause the device to exit its "current mode" and enter a next mode (i.e. exit the TOD and enter the CHRONO mode) even if an electrical signal is generated. If however, another electrical signal is detected at Block 60, control passes to Block 65 where the aforementioned Counter is incremented.

If at Block 70 it is determined that a certain number of the electrical signals were detected (such as four (4)) prior to the expiration of the Input Timer (which preferably has a duration of about 2.5 seconds), then the mode change at Block 75 will occur upon the electrical signal that caused the Counter to be greater than the Threshold Count (i.e. set at four (4) in this example). If it is determined that the number of electrical signals generated prior to the expiration of the Input Timer is less than the threshold value, the electronic device is not permitted to exit the current mode.

For example, one can easily envision a user having left the watch in the TOD mode, and now wishes to cause the watch to exit the TOD mode (i.e. the "current mode") and enter the next mode in the cycle of modes. In order to achieve this result, the user must cause the setting stem to rotate sufficiently to generate the predetermined number of electrical signals within the predetermined period of time (i.e. before the expiration of the Input Timer).

In accordance with the aforementioned "second" aspect of the present invention, after the electronic device has entered the next mode from the then "current mode", control then passes to Block 80 where it is determined whether the "next mode" (i.e. the "next" mode is now the mode that the watch is currently in having exited what was previously the "current" mode) is the "home" mode. The user or manufacturer could customize this "home" mode in a highly sophisticated electronic device embodiment. For example, a marathon runner may wish to set the CHRONO as the "home" mode. In the present contemplated embodiment however, the TOD mode is deemed the "home" mode. At Block 80 it is determined whether the mode in which the device has just entered is the "home" mode. If it is, the present invention assumes that the user does not wish to immediately cycle any further in and among the plurality of modes. For this purpose, control then passes to Blocks 85 and 90 wherein a "Home" Mode Timer is initiated. This Home Mode Timer ensures that upon the exiting of a previously current mode and the entering of the "home" mode, the user cannot inadvertently exit the "home" mode. That is, for example, the implementation of the present invention assumes that the user does not desire to cycle past the "home" mode. In this way, the present invention further carries out the objectives set forth above, namely, the prevention of overrotation/inadvertent rotation of the setting stem. For the purpose of clarity and an understanding of the claims, once the device enters a "next" mode, this "next" mode would be thereafter considered the "current" mode. Such an understanding eliminates the need to redefine the "next" mode as the "current" mode each time the device cycles through another mode.

If, at Block 80, it is determined that the then "current" mode in not the "home" mode or that the Home Mode Timer has expired at Block 90, control then passes to Block 15 where the crown lock condition is reset (i.e. "unlocked") and a Start Timer is initiated at Block 20. As should now be well understood by one of ordinary skill in the art, the passing of control to Blocks 15 and 20 as set forth continues to permit a user to cycle through the device's existing modes without undue delay. That is, if a user is in the process of setting the watch in the various modes, the "crown lock condition" will be unlocked at Block 15 and if the Start Timer has not expired at Block 25 and signals are repeatedly being detected, the device will follow the "No" path at Block 40 and immediately change modes upon each detected electrical signal. However, if the Start Timer expires before a subsequent electrical signal is detected, the crown locked condition is locked at Block 30, and the entire process of requiring the receipt of a plurality of electrical signals is repeated so as to ensure the rotation of the setting stem is not inadvertent or unintentional. As would be understood, the initiation of the Start Timer (which has a duration of about 6 seconds) at Block 20 is implemented to ensure that continued use of the device remains uninterrupted and undelayed as long as rotational signals are continually detected prior to the expiration of the Start Lock Timer. Thus, it can clearly be seen how this aspect of the invention, namely the crown locking condition, is carried out.

It will thus be seen that the objects set forth above, among those made apparent from the preceding description, are efficiently attained and, since certain changes may be made in the above methodologies without departing from the spirit and scope of the invention, it is intended that all matter contained in the above description or shown in the accompanying drawings shall be interpreted as illustrative and not in a limiting sense.

For example, the sequence of steps in the FIG. 1 may be slightly modified, such as having the decision step of Block 60 appear before the decision step of Block 55 within the loop sequence. That is, checking for another electrical signal need not be done only when the current timeout expires.

While the present invention has been described with reference to a top ring or crown to effectuate the rotation of the setting stem, other modifications can be made to the device while still remaining within the scope of the present invention. For example, and in a manner similar to that described in the aforementioned application Ser. No. 09/359,223, it should be understood that the intermittent electrical signals could be generated in a number of different ways, such as by the use of touch sensitive areas, constructed as digitized areas generally referred to as "touch pads" similar to those utilized in laptop and notebook type personal computers. Alternatively, the rotational switching mechanism described herein by way of a rotating setting stem, clickwheel assembly and elongated arms (see application Ser. No. 09/264,523) or the setting stem and switch arm assembly in application Ser. No. 09/327,769 could be effectuated by the use of a slide switch axially moveable within a groove, such that when moved from a "neutral" position leftwardly or rightwardly, similar intermittent electrical signals are generated. Other methods to effectuate the electrical signals are known although not material to the present invention and can be more particularly described in the aforementioned application Ser. No. 09/327,769.

Lastly, it should be understood that while the objects and advantages of the present invention are achieved as set forth above, some of them may also be achieved by way of a mechanical switch, operatively coupled to the microprocessor, for permitting setting functions to take place. That is, one skilled in the art should recognize that some of the foregoing objects and advantages could be achieved by requiring a user to toggle a switch from an "off" position to an "on" position when setting of the watch is desired. Once setting of the watch is completed, the user would toggle the switch to the "off" position. With the switch in the "off" position, the inadvertent or undesirable contact with the top ring or crown would not permit the watch or other electronic device to change modes or other displayed information. When setting is desired, the switch is toggled to the "on" position thereby allowing the microprocessor to be operative in the foregoing manner.

And finally, while the present invention has been disclosed above with reference to timepieces, and watches in particular, one skilled in the art shall now appreciate that the present invention is equally applicable, and as claimed herein, to other devices, such as, but not limited to, clocks, thermostats such as wall mounted thermostats, and security devices such as wall mounted or handheld devices for the home or office. Therefore, any particular reference to a particular type of device should be understood to be exemplary and not in a limiting sense.

What is claimed is:

1. A method of setting a multimode electronic device of the type having a switching mechanism that generates intermittent electrical signals when the switching mechanism is displaced in either a first or second direction and an integrated circuit operable in at least a current mode, a mode setting mode and a next mode and operatively coupled to the switching mechanism, the method comprising the steps of:

determining whether a crown lock condition is locked, and if so, determining whether a predetermined number of electrical signals are generated prior to the expiration of a predetermined period of time, and if the crown lock condition is not locked, causing the electronic device to exit the current mode and enter the next mode without determining whether the predetermined number of electrical signals are generated prior to the expiration of the predetermined period of time.

2. The method as claimed in claim 1, wherein the switching mechanism includes a rotating setting stem and the electronic device is a watch.

3. A method of setting a multimode electronic device of the type having a switching mechanism that generates intermittent electrical signals when the switching mechanism is displaced in either a first or second direction and an integrated circuit operable in at least a current mode, a mode setting mode and a next mode and operatively coupled to the switching mechanism, the method comprising the steps of:

detecting one or more first electrical signals generated by the switching mechanism;

determining whether at least a predetermined number of electrical signals are generated prior to the expiration of a predetermined period of time, and if so:

causing the electronic device to exit the current mode and enter the next mode; and if not:

not permitting the electronic device to exit the current mode and enter the next mode.

4. The method as claimed in claim 3, including the step of:

determining that a crown lock condition is locked after detecting the first electrical signal generated by the switching mechanism; and determining whether a predetermined number of electrical signals are generated prior to the expiration of a predetermined period of time and if so, causing the electrical device to exit the current mode and enter the next mode.

5. A method of setting a multimode electronic device of the type having a switching mechanism that generates intermittent electrical signals when the switching mechanism is displaced in either a first or second direction and an integrated circuit operable in at least a current mode, a mode setting mode and a next mode and operatively coupled to the switching mechanism, the method comprising the steps of:

detecting first electrical signals generated by the switching mechanism;

determining whether a predetermined number of electrical signals are generated prior to the expiration of a predetermined period of time, and if so, causing the electronic device to exit the current mode and enter the next mode; and after causing the electronic device to exit the current mode and enter the next mode, the steps of:

unlocking a crown lock condition and starting a locking timer;

determining whether another signal generated by the switching mechanism is detected prior to the expiration of the locking timer; and if so causing the electronic device to exit the current mode and enter a next mode.

6. The method as claimed in claims 5, wherein if the signal generated by the switching mechanism is detected after the expiration of the locking timer, the method comprising the further steps of:

locking the crown lock condition;

determining whether a predetermined number of electrical signals are generated prior to the expiration of a predetermined period of time, and if so causing the electronic device to exit the current mode and enter a next mode.

7. The method as claimed in claim 5, wherein if the locking timer expires prior to the detection of a signal generated by the switching mechanism, the method comprising the further steps of:

locking the crown lock condition;

determining whether a predetermined number of further electrical signals are generated prior to the expiration of the predetermined period of time, and if so causing the electronic device to exit the current mode and enter a next mode.

8. A method of setting a multimode electronic device of the type having a switching mechanism that generates electrical signals when the switching mechanism is displaced in either a first or second direction and an integrated circuit operatively coupled to the switching mechanism and operable in a plurality of modes including at least a current mode, a mode setting mode, a next mode and a home mode, the entering of which from a current mode prohibits the exiting thereof for a predetermined period of time, the method comprising the steps of:

while the electronic device is in the current mode, detecting a electrical signal generated by the switching mechanism;

causing the electronic device to exit the current mode and enter a next mode;

determining whether the next mode is the "home" mode and if so not permitting the electronic device to exit the "home" mode and enter a next mode for a predetermined period of time even if the switching mechanism is being displaced in a first or second direction during the predetermined period of time.

9. The method as claimed in claim 8, including, after determining that the next mode is the "home" mode, the steps of:

initializing a mode timer;

not permitting the electronic device to exit the "home" mode and enter the next mode until the expiration of the mode timer.

10. The method as claimed in claim 8, wherein the switching mechanism includes a rotating setting stem and the electronic device is a watch.

11. A method of setting a multimode electronic device of the type having a switching mechanism that generates electrical signals when the switching mechanism is displaced in either a first or second direction and an integrated circuit operable in at least a current mode, a mode setting mode and a next mode and operatively coupled to the switching mechanism, the method comprising the steps of:

determining whether a crown lock condition is locked, and if so, preventing the electronic device from exiting the current mode and entering the next mode until a predetermined number of electrical signals are generated prior to the expiration of a predetermined period of time.

12. The method as claimed in claim 11, including the steps of:

unlocking the crown lock condition;

starting a lock timer;

determining whether an electrical signal is detected prior to the expiration of the lock timer, and if not; locking the crown lock condition.

13. The method as claimed in claim 12, including, after the step of locking the crown lock condition, the steps of:

detecting a first electrical signal generated by the switching mechanism;

determining whether a predetermined number of electrical signals are generated prior to the expiration of a predetermined period of time, and if so causing the electronic device to exit the current mode and enter the next mode.

14. The method as claimed in claim 11, wherein the switching mechanism includes a rotating setting stem and the electronic device is a watch.

15. A method for setting a multimode electronic device of the type comprising a rotating switching mechanism that generates intermittent electrical signals when the rotating switching mechanism is rotated in a first or second direction, an integrated circuit that processes the intermittent electrical signals, is operatively coupled to the rotating switching mechanism and is operable in at least a mode changing mode and an information setting mode, and a mechanical switch, operatively coupled to the integrated circuit, wherein the method comprises the steps of:

moving the mechanical switch from a first position to a second position when a changing of the mode of the electronic device is desired;

changing the mode of the electronic device by causing the rotation of the rotating switching mechanism; and upon completion of the changing step, moving the mechanical switch from the second position to the first position;

wherein when the mechanical switch is in the first position the integrated circuit does not process the intermittent electrical signals even if the rotating switching mechanism is rotated in a first or second direction, and when the mechanical switch is in the second position the integrated circuit does process the intermittent electrical signals when generated by the rotating switching mechanism;

whereby inadvertent changing of the modes of the electronic device is prevented when the mechanical switch is in its first position.

16. The method as claimed in claim 15, wherein the first position is an off position and the second position is the on position, and further wherein the electronic device is a wristwatch.

* * * * *